US010267534B2

(12) United States Patent
Fukui et al.

(10) Patent No.: US 10,267,534 B2
(45) Date of Patent: Apr. 23, 2019

(54) INDOOR UNIT FOR AIR-CONDITIONING APPARATUS, AND AIR-CONDITIONING APPARATUS

(71) Applicants: Tomoya Fukui, Chiyoda-ku (JP); Masayuki Oishi, Chiyoda-ku (JP); Shoji Yamada, Chiyoda-ku (JP)

(72) Inventors: Tomoya Fukui, Chiyoda-ku (JP); Masayuki Oishi, Chiyoda-ku (JP); Shoji Yamada, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 153 days.

(21) Appl. No.: 14/889,059

(22) PCT Filed: May 8, 2013

(86) PCT No.: PCT/JP2013/062930
§ 371 (c)(1),
(2) Date: Nov. 4, 2015

(87) PCT Pub. No.: WO2014/181398
PCT Pub. Date: Nov. 13, 2014

(65) Prior Publication Data

US 2016/0084520 A1 Mar. 24, 2016

(51) Int. Cl.

| | |
|---|---|
| ***F24F 13/22*** | (2006.01) |
| ***F24F 13/30*** | (2006.01) |
| ***F25B 39/02*** | (2006.01) |
| ***F24F 1/0033*** | (2019.01) |
| ***F24F 1/00*** | (2019.01) |

(52) U.S. Cl.
CPC ..... *F24F 13/22* (2013.01); *F24F 1/00* (2013.01); *F24F 1/0033* (2013.01); *F24F 13/30* (2013.01); *F25B 39/028* (2013.01)

(58) Field of Classification Search
CPC ..... F24F 1/0007; F24F 1/0029; F24F 1/0033; F24F 1/16; F24F 1/18; F24F 1/48; F24F 13/22; F24F 13/30; F24F 2001/0037
See application file for complete search history.

(56) References Cited

U.S. PATENT DOCUMENTS 4,274,481 A 6/1981 Ireland et al.
4,470,271 A * 9/1984 Draper ..... F24F 1/16 165/124

(Continued)

FOREIGN PATENT DOCUMENTS

CN 102374588 A 3/2012
JP 62-100475 U 6/1987

(Continued)

OTHER PUBLICATIONS

International Search Report dated Jul. 16, 2013 for PCT/JP2013/062930 filed on May 8, 2013.

(Continued)

*Primary Examiner* — Christopher R Zerphey
(74) *Attorney, Agent, or Firm* — Oblon, McClelland, Maier & Neustadt, L.L.P.

(57) ABSTRACT

A heat exchanger includes a plurality of bent parts where a direction of slope of the heat exchanger changes from an upward direction to a downward direction or from a downward direction to an upward direction. The plurality of bent parts is provided on each of a side of an air inlet and a side of an air outlet. The heat exchanger is provided such that all of the plurality of bent parts is visible when the heat exchanger is seen from a front side of a casing. Drain pans are provided below each of the plurality of bent parts that are on the side of the air outlet.

10 Claims, 7 Drawing Sheets

(56) References Cited

U.S. PATENT DOCUMENTS

| | | | | |
|---|---|---|---|---|
| 5,121,613 | A * | 6/1992 | Cox | F24F 1/0007 165/127 |
| 5,211,219 | A | 5/1993 | Kawabata et al. | |
| 7,185,513 | B2 * | 3/2007 | Bush | F24F 1/0007 62/476 |
| 9,410,709 | B2 * | 8/2016 | Kopko | F24F 1/16 |
| 2012/0031134 | A1 * | 2/2012 | Shirota | F24F 1/0029 62/288 |
| 2012/0031139 | A1 | 2/2012 | Shirota et al. | |

FOREIGN PATENT DOCUMENTS

| | | | |
|---|---|---|---|
| JP | 03-156221 | A | 7/1991 |
| JP | 10-259931 | A | 9/1998 |
| JP | 2000-146218 | A | 5/2000 |
| JP | 2002-228193 | A | 8/2002 |
| JP | 2003-207152 | A | 7/2003 |
| WO | 2010/089920 | A1 | 8/2010 |

OTHER PUBLICATIONS

Office Action dated Dec. 18, 2015 in German Patent Application No. 11 2013 007 044.8 with English translation.

Combined Chinese Office Action and Search Report dated Apr. 19, 2017 in Patent Application No. 201380076374.5 (with partial English translation and English translation of categories of cited documents).

Office Action dated Jan. 2, 2018 in Chinese Patent Application No. 201380076374.5 with unedited computer generated English translation.

Chinese Office Action dated Jun. 5, 2018, issued in Chinese Patent Application No. 201380076374.5 (with English translation).

* cited by examiner

INDOOR UNIT FOR AIR-CONDITIONING APPARATUS, AND AIR-CONDITIONING APPARATUS

TECHNICAL FIELD

The present invention relates to an indoor unit including an air-sending device and a heat exchanger that are housed in a casing, and to an air-conditioning apparatus including the indoor unit.

BACKGROUND ART

There are hitherto known indoor units that are intended for air-conditioning apparatuses and each include an air-sending device and a heat exchanger that are housed in a casing. One of proposals relating to such indoor units is an air-conditioning apparatus including a casing having an air inlet at a top and an air outlet on a lower side of a front face, an axial-flow or mixed-flow air-sending device provided in the casing and on a downstream side with respect to the air inlet, and a heat exchanger provided in the casing and on a downstream side with respect to the air-sending device and on an upstream side with respect to the air outlet, the heat exchanger allowing air blown from the air-sending device and refrigerant to exchange heat with each other" (see Patent Literature 1, for example). The indoor unit includes the air-sending device provided at the air inlet, and the heat exchanger provided on the downstream side with respect to the air-sending device. When the air-sending device is driven, indoor air taken from the air inlet and the refrigerant flowing in the heat exchanger exchange heat with each other. Thus, air-conditioning is performed.

The heat exchanger of the above indoor unit has a substantial Λ shape in vertical sectional right-side view of the air-conditioning apparatus.

The heat exchanger is divided into a front-side heat exchanger and a rear-side heat exchanger. The front-side heat exchanger is positioned on the front side with respect to a line of symmetry given in the substantial center of the vertical right-side section of the air-conditioning apparatus. The rear-side heat exchanger is positioned on the rear side with respect to the line of symmetry. The volume of air flowing through the rear-side heat exchanger is made larger than the volume of air flowing through the front-side heat exchanger. Thus, air is allowed to flow toward the air outlet provided on the lower side of the front face of the casing, without forcibly bending the flow of the air by using the casing. Furthermore, such a configuration contributes to the realization of low power consumption and low noise.

CITATION LIST

Patent Literature

Patent Literature 1: WO10/089920 (see [0006] and FIGS. 5 to 7, for example)

SUMMARY OF INVENTION

Technical Problem

In the indoor unit included in the air-conditioning apparatus according to Patent Literature 1, as the shape of the heat exchanger in vertical sectional right-side view of the air-conditioning apparatus is modified from the substantial Λ shape to a substantial mirrored-N shape and then to a substantial M shape, the volume of air flowing through the heat exchanger becomes larger. Consequently, the performance (heat-exchangeability) of the air-conditioning apparatus can be improved.

However, if the shape of the heat exchanger is modified as described above, the number of bent parts (parts where the direction of slope of the heat exchanger changes from an upward direction to a downward direction or from a downward direction to an upward direction) of the heat exchanger increases. Correspondingly, the number of drain pans increases. Consequently, depending on the dimensions of the casing (the dimensions of the product), the blowoff area at the air outlet may be reduced extremely. Therefore, the pressure loss around the air outlet may increase, leading to a problem of deterioration in the performance of the air-conditioning apparatus.

In the indoor unit included in the air-conditioning apparatus according to Patent Literature 1, increasing the number of heat exchangers provided also improves the performance of the air-conditioning apparatus.

To increase the number of heat exchangers provided, the dimensions of the casing of the indoor unit need to be increased. However, considering the possibility that the indoor unit may be installed in a place such as a house with a low ceiling (a Japanese house, for example), a space above the entrance door, or the like, the dimensions of the casing are restricted especially in terms of height. Furthermore, depending on the shape of the room in which the indoor unit is to be installed, or if the indoor unit is installed between pillars or the like, the width of the indoor unit is also restricted. That is, the thickness is least restricted.

However, if the thickness of the casing of the indoor unit is changed, the arrangement of the heat exchanger and the arrangement of the air passage need to be redesigned for every such change, leading to a problem of a long development period for the mass production of such an apparatus.

The present invention is to solve at least one of the above problems and provides an indoor unit for an air-conditioning apparatus and an air-conditioning apparatus in which the performance of the air-conditioning apparatus can be improved without increasing the pressure loss around the air outlet even if the heat exchanger has a larger number of bent parts than in the known art.

Solution to Problem

An indoor unit for an air-conditioning apparatus according to the present invention includes a casing having an air inlet at a top and an air outlet at a bottom, an air-sending device provided in the casing and on a downstream side of the air inlet and including an axial-flow fan or a mixed-flow fan, and a heat exchanger provided in the casing and between the air-sending device and the air outlet. The heat exchanger includes a plurality of bent parts where a direction of slope of the heat exchanger changes from an upward direction to a downward direction or from a downward direction to an upward direction. The plurality of bent parts are provided on each of a side of the air inlet and a side of the air outlet. The heat exchanger is provided such that all of the plurality of bent parts are visible when the heat exchanger is seen from a front side of the casing. Drain pans are provided below each of the plurality of bent parts that are on the side of the air outlet.

Advantageous Effects of Invention

In the indoor unit for an air-conditioning apparatus according to the present invention, the performance of the air-conditioning apparatus can be improved without increasing the pressure loss around the air outlet even if the heat exchanger has a larger number of bent parts than in the known art. Furthermore, the thickness of the heat exchanger in the thickness direction of the casing only needs to be changed in accordance with the required cooling and heating capacity and the required heat-exchangeability of the indoor unit. Consequently, the design can be simplified, and the development period can be shortened.

DESCRIPTION OF EMBODIMENTS

Figure 1:
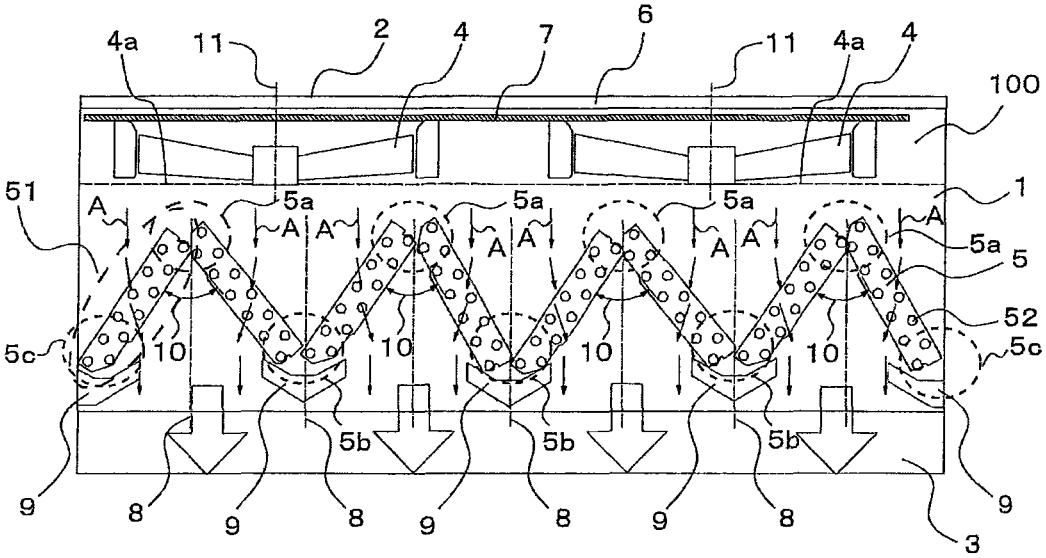
FIG. 1 is a vertical sectional view of an exemplary indoor unit for an air-conditioning apparatus (hereinafter denoted as indoor unit 100) according to Embodiment 1 of the present invention.

Embodiments of the present invention will be described below with reference to the accompanying drawings. Note that the following embodiments do not limit the present invention. Elements illustrated in the drawings are not necessarily scaled according to their actual sizes. The following embodiments concern exemplary cases where indoor units 100 to 106 are of wall-mounted type and are each to be installed on a wall of an air-conditioned area. A side of each of the indoor units 100 to 106 that faces the wall on which the indoor unit is mounted is defined as the rear face, and the opposite side is defined as the front face.

Embodiment 1

FIG. 1 is a vertical sectional view of an exemplary indoor unit for an air-conditioning apparatus (hereinafter denoted as indoor unit 100) according to Embodiment 1 of the present invention. The front side in FIG. 1 corresponds to the front face of the indoor unit 100.

The indoor unit 100 according to Embodiment 1 of the present invention supplies conditioned air to an air-conditioned area, such as an indoor space, by using a refrigeration cycle through which refrigerant circulates.

The indoor unit 100 basically includes a casing 1 having an air inlet 2 from which indoor air is taken in and an air outlet 3 from which conditioned air is supplied to the air-conditioned area, air-sending devices 4 provided in the casing 1 and that each take in indoor air from the air inlet 2 and blow off conditioned air from the air outlet 3, and a heat exchanger 5 provided in an air duct extending from the air inlet 2 to the air outlet 3 and that generates conditioned air by allowing the refrigerant and the indoor air to exchange heat with each other. A combination of the above elements provides air passages (arrows A) in the casing 1.

The air inlet 2 is provided as an opening at the top of the casing 1. The air outlet 3 is provided as an opening at the bottom of the casing 1 (more specifically, on the front side at the bottom of the casing 1). The air-sending devices 4 are provided on the downstream side (on the side of the air outlet 3) with respect to the air inlet 2 and on the upstream side (on the side of the air inlet 2) with respect to the heat exchanger 5. The air-sending devices 4 are each an axial-flow fan or a mixed-flow fan. The heat exchanger 5 is provided on the leeward side of the air-sending devices 4. The heat exchanger 5 may preferably be, for example, a plate-fin-tube or corrugated-fin-tube heat exchanger 5. The following description concerns an exemplary case of a plate-fin-tube heat exchanger 5. The air inlet 2 is provided with a finger guard 6 and a filter 7. The air outlet 3 is provided with a mechanism that controls the direction in which air is blown, such as a vane or the like (not illustrated).

The indoor unit 100 further includes a motor provided for purposes such as the driving of the vane, an electrical control circuit board, and the like (not illustrated).

The flow of air in the indoor unit 100 will be described briefly below.

First, when impellers of the air-sending devices 4 rotate about respective rotating shafts 11, indoor air flows into the indoor unit 100 from the air inlet 2 provided at the top of the casing 1. At this time, the filter 7 removes dust from the indoor air. The indoor air is blown from air-sending-device air outlets 4*a* toward the heat exchanger 5. When the indoor air passes through the heat exchanger 5, the indoor air is heated or cooled by the refrigerant flowing in the heat exchanger 5, thereby turning into conditioned air. The conditioned air is blown from the air outlet 3 provided at the bottom of the casing 1 to the outside of the indoor unit 100, that is, to the air-conditioned area.

The indoor air and the conditioned air are hereinafter simply referred to as air.

The heat exchanger 5 will be described below.

As illustrated in FIG. 1, the heat exchanger 5 has a plurality of parts where the direction of slope thereof changes from an upward direction to a downward direction or from a downward direction to an upward direction (hereinafter such parts are referred to as bent parts). The plurality of bent parts are provided on each of the side of the air inlet 2 (these bent parts are hereinafter referred to as mountain-side bent parts 5*a*) and the side of the air outlet 3 (these bent parts are hereinafter referred to as valley-side bent parts 5*b*). Thus, the heat exchanger 5 has a substantial MM shape in vertical sectional front view. That is, a portion of the heat exchanger 5 that extends between adjacent ones of boundaries 8 passing through the substantial centers of the respective bent parts is denoted as elemental heat exchanger 51. Each pair of such elemental heat exchangers 51 on the right and left sides, respectively, of a corresponding one of the boundaries 8 slope in opposite directions. The heat exchanger 5 includes pipes 52 in which the refrigerant flows, and plate fins. The pipes 52 form refrigerant passages each extending in the anteroposterior direction of the heat exchanger 5 (in a direction orthogonal to the plane of FIG. 1). The plate fins each extend perpendicularly to the pipes 52 and are arranged in such a manner as to form layers stacked in the anteroposterior direction of the heat exchanger 5. The heat exchanger 5 has right and left ends (on the right and left sides, respectively, in FIG. 1). The right end is denoted as downslope end 5*c* when it is positioned at the lower rightmost one of the bent parts, or as upslope end 5*d* when it is positioned at the upper rightmost one of the bent parts. Likewise, the left end is denoted as downslope end 5*c* when it is positioned at the lower leftmost one of the bent parts, or as upslope end 5*d* when it is positioned at the upper leftmost one of the bent parts.

Drain pans 9 are provided below the valley-side bent parts 5*b* and the downslope ends 5*c*, respectively. The drain pans 9 receive drops of water condensed on the heat exchanger 5 during a cooling operation or the like. That is, drops of water condensed on the surfaces of the heat exchanger 5 run down along the surfaces toward positions above the drain pans 9 and fall onto the drain pans 9.

The internal angle formed at each of the bent parts of the heat exchanger 5 is denoted as attaching angle 10. If the attaching angle 10 is larger than a specific angle, dewdrops may fall off before reaching the positions above the drain pans 9, making it difficult to collect such dewdrops by the drain pans 9. Therefore, the attaching angle 10 is designed to be smaller than or equal to an attaching-angle limit of about 70 to 80 degrees.

However, the attaching angle 10 is not limited to the above when there is no chance of generation of dewdrops on the heat exchanger 5, such as in a heating operation.

Figure 2A:
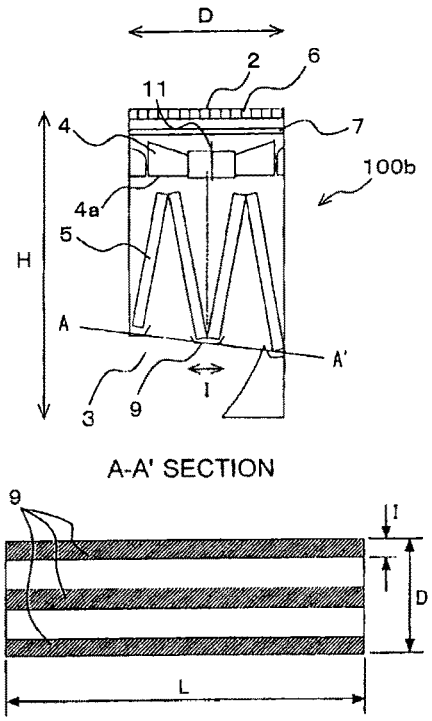
FIG. 2A includes a vertical sectional right-side view and an A-A' sectional view of an indoor unit for an air-conditioning apparatus according to known art.
Figure 2B:
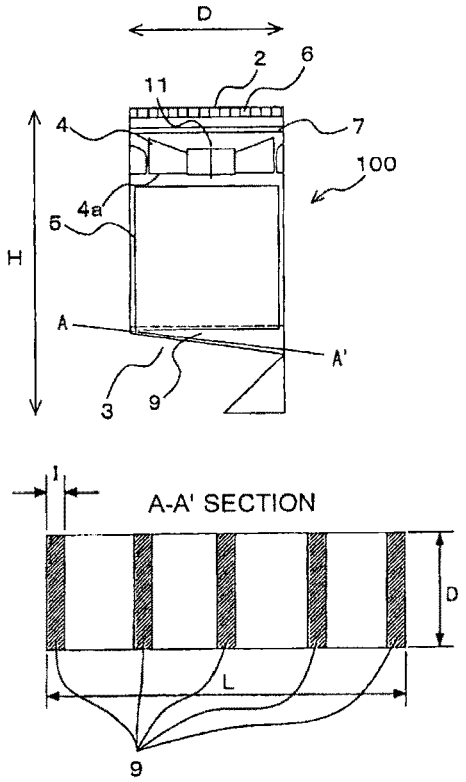
FIG. 2B includes a vertical sectional right-side view and an A-A' sectional view of the indoor unit for an air-conditioning apparatus according to Embodiment 1 of the present invention.

Fig 2A and FIG. 2B include vertical sectional right-side views and A-A' sectional views of different indoor units for air-conditioning apparatuses. FIG. 2A illustrates an indoor unit 100*b* for an air-conditioning apparatus according to a known art (illustrated in FIG. 7 of Patent Literature 1). FIG. 2B illustrates the indoor unit 100 for an air-conditioning apparatus according to Embodiment 1 of the present invention.

The blowoff area (the area obtained by subtracting the area of the drain pans from the area of the air outlet 3) of each of the indoor unit 100*b* for an air-conditioning apparatus according to the known art (illustrated in FIG. 7 of Patent Literature 1) and the indoor unit 100 for an air-conditioning apparatus according to Embodiment 1 of the present invention will be described below. In each of the A-A' sectional views, the white parts represent areas of the air outlet 3, and the black parts represent areas of the drain pans. The heat exchanger 5 of the indoor unit 100*b* has a substantial M shape in vertical sectional right-side view, whereas the heat exchanger 5 of the indoor unit 100 has a substantial MM shape in vertical sectional front view. That is, the heat exchangers 5 of the indoor unit 100*b* and the indoor unit 100 are in respective orientations that are different from each other by 90 degrees.

The height of the casing 1 is denoted as H, the width of the casing 1 is denoted as L, the thickness of the casing 1 (the length of the casing 1 in the anteroposterior direction) is denoted as D, the width of each drain pan 9 is denoted as I, the number of drain pans 9 included in the indoor unit 100*b* is denoted as N1, and the number of drain pans 9 included in the indoor unit 100 is denoted as N2. The indoor unit 100*b* and the indoor unit 100 are assumed to have the same values of H, L, D, and I.

When the blowoff area of the indoor unit 100*b* is assumed to be S1 and the blowoff area of the indoor unit 100 is assumed to be S2, S1 and S2 are expressed as follows: $S1=D\times L-N1\times L\times I$, and $S2=D\times L-N2\times L\times I$.

That is, the relationship between S1 and S2 is expressed as $S2>S1$ when $N1\times L>N2\times D$. Accordingly, the indoor unit 100 has a larger blowoff area. The indoor unit 100 having the larger blowoff area can reduce the pressure loss around the air outlet 3.

In a case of an indoor unit for a wall-mounted air-conditioning apparatus, the dimensions of the casing 1 are typically as follows: height H =250 to 350 mm, thickness D =200 to 350 mm, and width L =700 to 800 mm (the values vary to some extent with the cooling and heating capacity of the air-conditioning apparatus). Hence, a case where H =300 mm, D =280 mm, and L =750 mm will be discussed below. In the arrangement illustrated in FIG. 2A where the heat exchanger 5 has a substantial M shape, the number N1 of drain pans 9 is three. Therefore, S2 is larger if N2 is less than eight.

Hence, to establish the relationship of $S2>S1$, N2 only needs to be seven or less. When the number N2 of drain pans 9 included in the indoor unit 100 is six, the sum of the number of valley-side bent parts 5*b* and the number of downslope ends 5*c* in the heat exchanger 5 is six. That is, regarding adjacent two of the elemental heat exchangers 51 that form a substantial Λ shape as a single unit, the width of the unit is $750/(6-1)=150$ mm. Furthermore, the attaching angle 10 at each bent part in a case where the heat exchanger 5 has a height of about 200 mm with respect to the height H of 300 mm is about 35 degrees. Therefore, the attaching angle 10 is well within the attaching-angle limit, and it is even possible to reduce the number of drain pans 9.

According to the above configuration, $S2>S1$ is satisfied. Therefore, in the indoor unit 100 for an air-conditioning apparatus according to Embodiment 1 of the present invention, the pressure loss around the air outlet 3 does not increase and is smaller, even with a larger number of bent parts, than in the indoor unit 100*b* for an air-conditioning apparatus according to the known art (illustrated in FIG. 7 of Patent Literature 1).

Furthermore, the heat exchanger 5 of the indoor unit 100 for an air-conditioning apparatus according to Embodiment 1 of the present invention has a substantial MM shape in vertical sectional front view. Therefore, to increase the thickness D of the casing 1, the thickness of the heat exchanger 5 (in the direction of the thickness D of the casing 1) only needs to be changed without changing the shape of the heat exchanger 5. Thus, the heat-exchangeability can be improved by increasing the mass of the heat exchanger 5 to be provided. That is, the thickness of the heat exchanger 5 only needs to be changed in accordance with the required cooling and heating capacity and the required heat-exchangeability of the indoor unit 100. Consequently, the design can be simplified, and the development period can be shortened.

Figure 3:
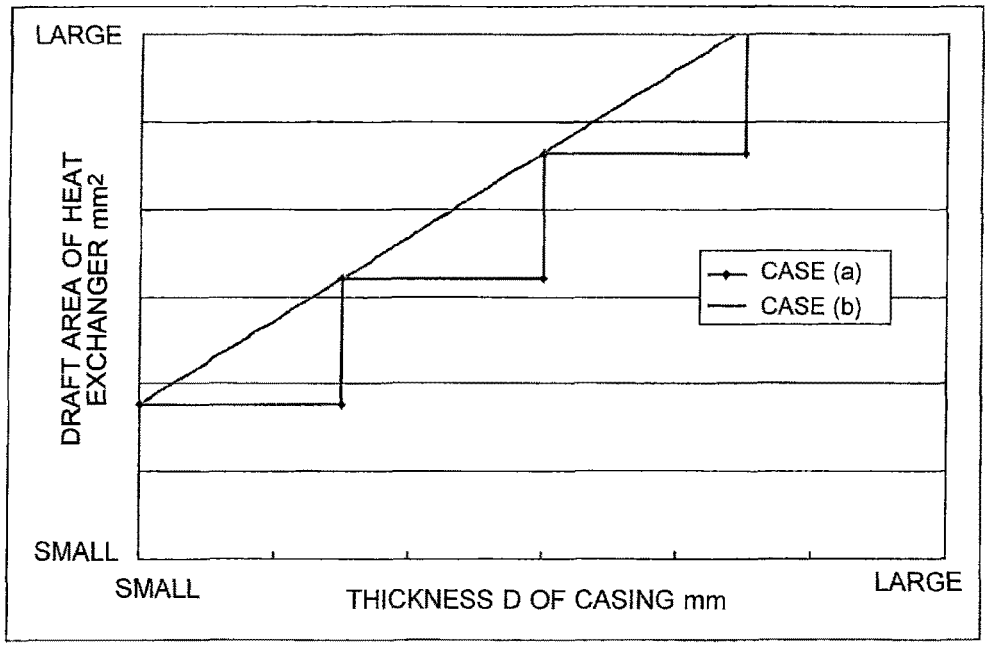
FIG. 3 illustrates the relationship between the thickness of a casing and the draft area of a heat exchanger in each of the indoor unit for an air-conditioning apparatus according to Embodiment 1 and a known indoor unit.

FIG. 3 illustrates the relationship between the thickness D of the casing and the draft area of the heat exchanger in each of the indoor unit 100 for an air-conditioning apparatus according to Embodiment 1 and the known indoor unit 100*b*. FIG. 3 illustrates the change in the draft area with respect to the change in the thickness D of the casing for each of the indoor unit 100*b*, graphed as case (a), and the indoor unit 100, graphed as case (b), L is assumed to be constant and the attaching angle at the bent part of the heat exchanger is assumed to be constant.

As graphed in FIG. 3, the draft area of the heat exchanger can be made larger in case (b) than in case (a) for most values of the thickness D. This is because of the following. In case (a), if the attaching angle at the bent part of the heat exchanger is made constant, it is impossible to add one more elemental heat exchanger unless the thickness D reaches a specific value. In contrast, in case (b), the size of the heat exchanger can be increased in the direction of the thickness D. Therefore, the draft area can be increased linearly with respect to the change in the thickness D.

Furthermore, in case (b) where a larger draft area (=heat transfer area) can be provided than in case (a), the wind speed can be made lower than in case (a) with the same volume of airflow. Therefore, the pressure loss in the heat exchanger itself can be reduced.

As described above, a larger draft area (=heat transfer area) can be provided in case (b) than in case (a). Therefore, if S2>S1, the heat-exchangeability can be made higher in case (b) than in case (a). Thus, the performance of the air-conditioning apparatus can be improved.

The configuration of the hitherto known indoor unit is not perfectly bilaterally symmetrical in front view. Therefore, dummy elements, such as dummy air outlets and dummy vanes are necessary for providing good design with bilaterally symmetrical appearance.

In the indoor unit 100 for an air-conditioning apparatus according to Embodiment 1 of the present invention, arrangement such as piping for connecting the pipes 52 of the heat exchanger 5 can be made on the front side or the rear side of the indoor unit 100. Therefore, the indoor unit 100 can have a perfectly bilaterally symmetrical configuration in front view. Accordingly, the design of the indoor unit 100 is improved, and dummy air outlets, dummy vanes, and other dummy elements are not necessary.

In the indoor unit 100*b* according to the known art (Patent Literature 1) in which the width L of the casing 1 is satisfactorily large with respect to the height H and the thickness D, the plate fins are stacked in the direction of the width L of the casing 1, and the length of each of the pipes 52 (the length in the direction of the width L of the casing 1) is large. Therefore, the heat exchanger 5 is more likely to warp.

In the indoor unit 100 for an air-conditioning apparatus according to Embodiment 1 of the present invention, the plate fins are stacked in the direction of the thickness D of the casing 1, and the length of each of the pipes 52 (the length in the direction of the thickness D of the casing 1) can be made smaller than that of the known art (Patent Literature 1). Therefore, the warpage of the heat exchanger 5 is suppressed. Accordingly, dimensional errors can be reduced. Consequently, the assembly work of the heat exchanger 5 is facilitated.

The configuration of the heat exchanger 5 of the indoor unit 100 illustrated in FIG. 1 is not limited to the above. For example, a plurality of elemental heat exchangers 51 may be combined together, or all of the elemental heat exchangers 51 may be integrated into a single unit.

Figure 4:
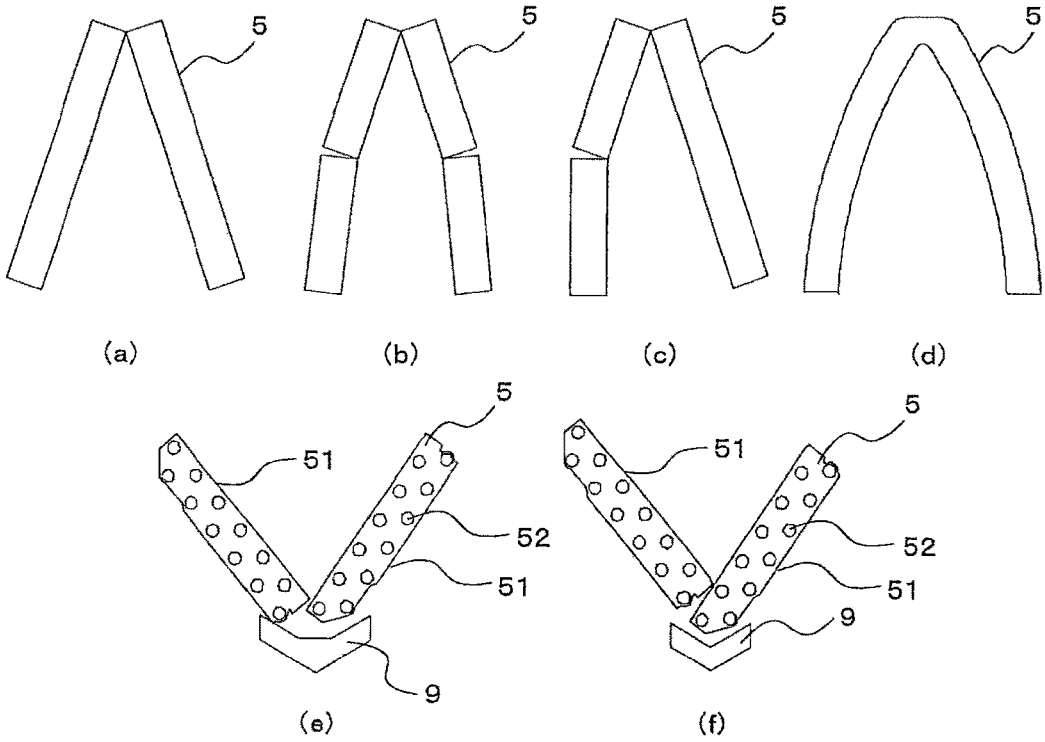
FIG. 4 includes side views of different heat exchangers ((a) to (f)).

FIG. 4 includes side views of different heat exchangers ((a) to (f)).

A plurality of kinds of heat exchangers 5 such as those illustrated in parts (a) to (d) of FIG. 4 (some are straight, whereas others are partially or generally curved) may be combined together. Moreover, there is no need to make each of all heat exchangers 5 of the heat exchanger 5 slope to the right or to the left with respect to a corresponding one of the boundaries 8 as illustrated in FIG. 1. Some of the heat exchangers 5 of the heat exchanger 5 may extend vertically. Furthermore, either an even number or an odd number of elemental heat exchangers 51 may be combined together. Furthermore, the respective lengths of adjacent ones of the elemental heat exchangers 51 in the longitudinal-direction length of the plate fins may be either the same or different. Furthermore, the respective values of pressure loss in adjacent ones of the elemental heat exchangers 51 may be either the same of different. Furthermore, the number of air-sending devices 4, which is two in the indoor unit 100 illustrated in FIG. 1, may be one or more than two.

If the configuration of the heat exchanger 5 illustrated in FIG. 4(*e*) is changed to the configuration illustrated in FIG. 4(*f*) in which the lower end of one of two adjacent elemental heat exchangers 51 faces a side face of the other elemental heat exchanger 51, the size of the drain pan 9 can be reduced. Consequently, the blowoff area can be increased. Note that the configuration of the heat exchanger 5 illustrated in FIG. 4(*e*) cannot be realized at each of the two ends of the casing 1. Therefore, the size reduction of the drain pans 9 is only realized for the drain pans 9 excluding those provided at the two ends of the casing 1.

Embodiment 2

The heat exchanger 5 may be configured as described below. The following description of Embodiment 2 of the present invention focuses on differences from Embodiment 1 described above. Elements that are the same as those described in Embodiment 1 are denoted by corresponding ones of the reference signs used therein.

Figure 5:
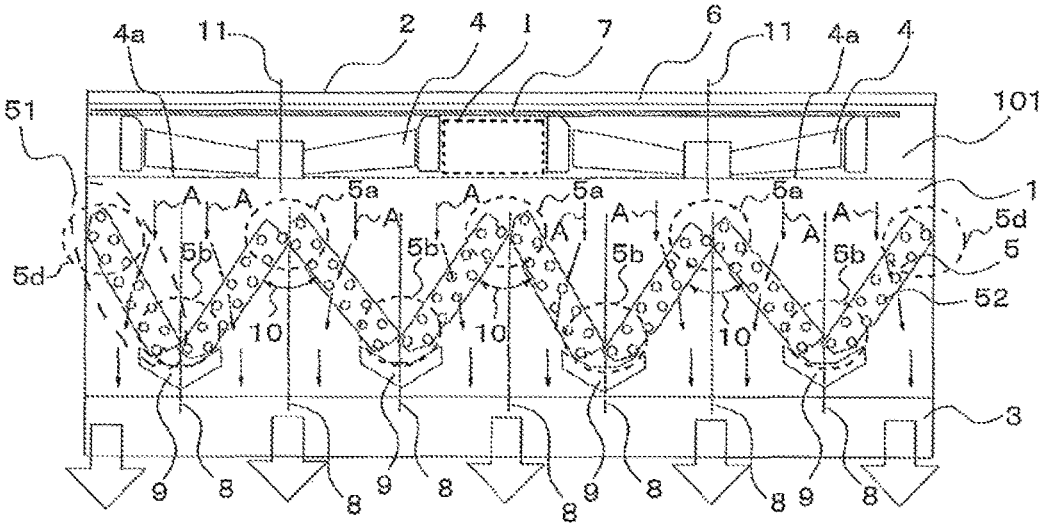
FIG. 5 is a vertical sectional view of an exemplary indoor unit for an air-conditioning apparatus (hereinafter denoted as indoor unit 101) according to Embodiment 2 of the present invention.

FIG. 5 is a vertical sectional view of an exemplary indoor unit for an air-conditioning apparatus (hereinafter denoted as indoor unit 101) according to Embodiment 2 of the present invention. The front side in FIG. 5 corresponds to the front face of the indoor unit 101.

The indoor unit 101 for an air-conditioning apparatus according to Embodiment 2 of the present invention differs from the indoor unit 100 for an air-conditioning apparatus according to Embodiment 1 in the arrangement of the heat exchanger 5.

In the heat exchanger 5, each pair of elemental heat exchangers 51 on the right and left sides, respectively, of a corresponding one of the boundaries 8 slope in opposite directions. Thus, the heat exchanger 5 has a substantial WW shape in vertical sectional front view.

The heat exchanger 5 of the indoor unit 100 for an air-conditioning apparatus according to Embodiment 1 has downslope ends 5*c* at the two respective ends (on the right and left sides in FIG. 1) of the casing 1. in contrast, the heat exchanger 5 of die indoor unit 101 for an air-conditioning apparatus according to Embodiment 2 has upslope ends 5*d* at the two respective ends (on the right and left sides in FIG. 5) of the casing 1. FIG. 5 also shows, for example, an entirety of a mountain-side bent part 5*a* that is provided below a non-limiting illustrative interval area 1 that is between adjacent air-sending devices 4. Air flowing through each of the two ends of the heat exchanger 5 of the indoor unit 100 for an air-conditioning apparatus according to Embodiment 1 flows out of the heat exchanger 5 in a direction perpendicular to the longitudinal direction of a corresponding one of the elemental heat exchangers 51 and in a direction away from a corresponding one of the side faces (the right side face at the right end or the left side face at the left end) of the easing 1. in contrast, air flowing through each of the two ends of the heat exchanger 5 of the indoor unit 101 for an air-conditioning apparatus according to Embodiment 2 flows out of the heat exchanger 5 in a direction perpendicular to the longitudinal direction of a corresponding one of the elemental heat exchangers 51 and in a direction toward a corresponding one of the side faces (the right side face at the right end or the left side face at the left end) of the casing 1.

Air flowing out of each of the elemental heat exchangers 51 that are at the two ends of the casing 1 of the indoor unit 101 for an air-conditioning apparatus according to Embodiment 2 flows toward a corresponding one of the side faces of the casing 1. Therefore, the wind speed at the air outlet 3 at the two ends of the casing 1 can be made higher than that of the indoor unit 100 for an air-conditioning apparatus according to Embodiment 1. Thus, it is possible to solve a quality problem of dew condensation (during the cooling operation, for example) due to backward flow that may occur if the wind speed at the air outlet 3 along the two sides of the casing 1 becomes low.

Furthermore, the number of drain pans 9 can be reduced by one, compared with that of the indoor unit 100 for an air-conditioning apparatus according to Embodiment 1, with the mass of the heat exchanger 5 unchanged. Although the number of valley-side bent parts 5*b* increases by one, the number of downslope ends 5*c* is reduced by two because the two ends of the heat exchanger 5 each form an upslope end 5*d*. Even if the two ends of the heat exchanger 5 each form an upslope end 5*d*, any members such as bowls that prevent water from dropping is considered to be necessary instead of the drain pans 9. Such a member can be provided with a simple structure including a thin plate and a heat-insulating material and in a smaller size than the drain pan 9. Therefore, unlike the drain pan 9, such a member does not cover a wide area of the air duct.

Hence, the blowoff area of the indoor unit 101 for an air-conditioning apparatus according to Embodiment 2 can be made larger and the number of drain pans 9 can be reduced, with the heat exchanger 5 having the same mass as that of the indoor unit 100 for an air-conditioning apparatus according to Embodiment 1.

According to the above configuration of the indoor unit 101 for an air-conditioning apparatus according to Embodiment 2, the number of drain pans 9 can be made smaller and the blowoff area at the air outlet 3 can be made larger than in the indoor unit 100 for an air-conditioning apparatus according to Embodiment 1.

Hence, the pressure loss around the air outlet 3 of the indoor unit 101 for an air-conditioning apparatus according to Embodiment 2 can be made smaller than that of the indoor unit 100 for an air-conditioning apparatus according to Embodiment 1.

Furthermore, it is possible to solve the quality problem of dew condensation (during the cooling operation, for example) due to backward flow.

The configuration of the heat exchanger 5 of the indoor unit 101 illustrated in FIG. 5 is not limited to the above, similarly to Embodiment 1.

Embodiment 3

The heat exchanger 5 may be configured as described below. The following description of Embodiment 3 of the present invention focuses on differences from Embodiment 1 or Embodiment 2 described above. Elements that are the same as those described in Embodiment 1 and Embodiment 2 are denoted by corresponding ones of the reference signs used therein.

Figure 6:
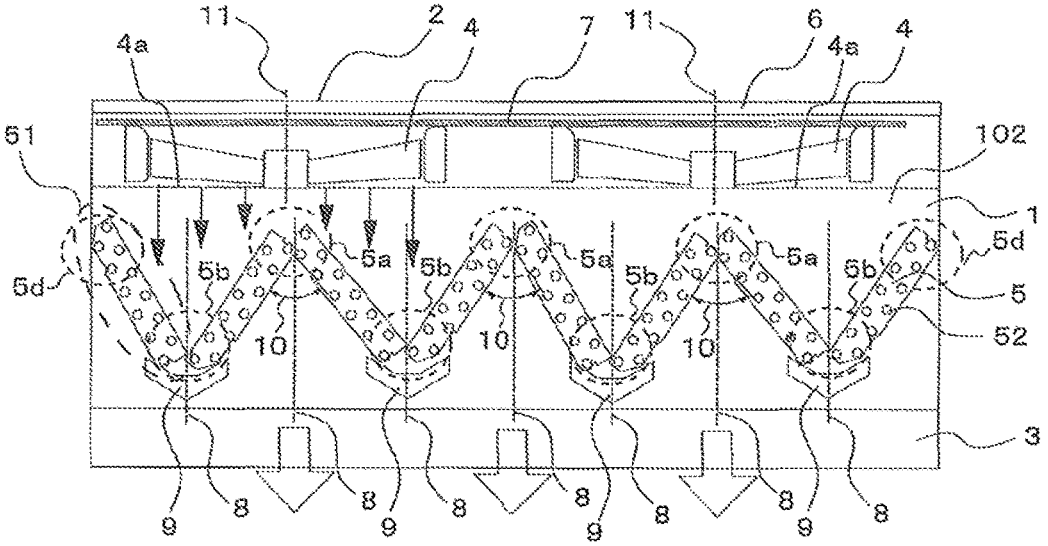
FIG. 6 is a vertical sectional view of an exemplary indoor unit for an air-conditioning apparatus (hereinafter denoted as indoor unit 102) according to Embodiment 3 of the present invention.
Figure 7:
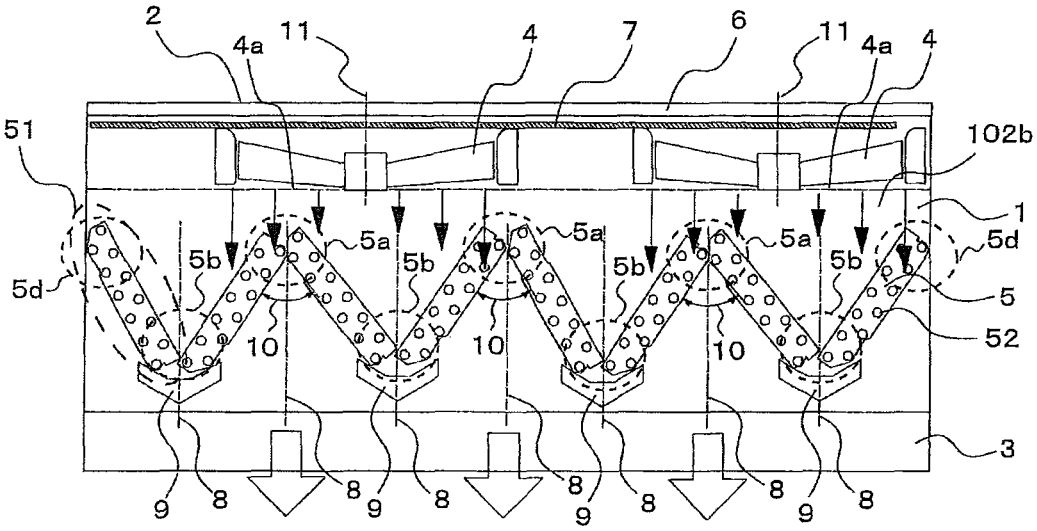
FIG. 7 is a vertical sectional view of an exemplary indoor unit for an air-conditioning apparatus (hereinafter denoted as indoor unit 102*b*) that is given for comparison with the indoor unit for an air-conditioning apparatus illustrated in FIG. 6.

FIG. 6 is a vertical sectional view of an exemplary indoor unit for an air-conditioning apparatus (hereinafter denoted as indoor unit 102) according to Embodiment 3 of the present invention. FIG. 7 is a vertical sectional view of an exemplary indoor unit for an air-conditioning apparatus (hereinafter denoted as indoor unit 102*b*) that is given for comparison with the indoor unit for an air-conditioning apparatus illustrated in FIG. 6.

In FIG. 7, the mountain-side bent parts 5*a* of the heat exchanger 5 are positioned on the downstream side (the lower side) of the outer peripheries of the impellers of the air-sending devices 4. In FIG. 6, some of the mountain-side bent parts 5*a* of the heat exchanger 5 are positioned on the downstream side of the rotating shafts 11 of the air-sending devices 4.

In the indoor unit 102 for an air-conditioning apparatus according to Embodiment 3 of the present invention, the positional relationship between the heat exchanger 5 and the air-sending devices 4 is defined more specifically than in Embodiment 1 and Embodiment 2. The front side in FIG. 6 corresponds to the front face of the indoor unit 102, and the front side in FIG. 7 corresponds to the front face of the indoor unit 102*b*.

The wind speed in the axial-flow direction on the downstream side of each of the air-sending devices 4 varies in the radial direction and increases from the inner side toward the outer side. Therefore, if the mountain-side bent parts 5*a* of the heat exchanger 5 are positioned on the downstream side of the outer peripheries of the impellers of the air-sending devices 4 (that is, in areas where the wind speed is high) as illustrated in FIG. 7, air flowing at a high wind speed collides with the mountain-side bent parts 5*a*, increasing the pressure loss at the heat exchanger 5. This is because the (mountain-side) bent parts each have a structure that is difficult for air to flow therethrough. Moreover, if the wind speed is high at the mountain-side bent parts 5*a* of the heat exchanger 5, the distribution of the wind speed in the heat exchanger 5 may deteriorate.

Accordingly, the positional relationship between heat exchanger 5 and the air-sending devices 4 in the indoor unit 102 according to Embodiment 3 of the present invention is defined as follows.

As illustrated in FIG. 6, some of the mountain-side bent parts 5*a* of the heat exchanger 5 included in the indoor unit 102 for an air-conditioning apparatus according to Embodiment 3 are positioned on the downstream side of the rotating shafts 11 of the air-sending devices 4, so that the number of mountain-side bent parts 5*a* positioned on the downstream side of the outer peripheries of the impellers of the air-sending devices 4 is made as smaller than that of the indoor unit 102*b* as possible. Note that all of the mountain-side bent parts 5*a* of the heat exchanger 5 are not necessarily positioned on the downstream side of the rotating shafts 11 of the air-sending devices 4. The mountain-side bent parts 5*a* only need be positioned in areas that do not face the air-sending-device air outlets 4*a* and where the wind speed is low, for example, on the downstream side of a space between adjacent ones of the air-sending devices 4.

According to the above configuration, the increase in the pressure loss at the heat exchanger 5 can be suppressed because the mountain-side bent parts 5*a* of the heat exchanger 5 are not positioned on the downstream side of areas where the wind speed of the air from the air-sending devices 4 is high. Thus, the distribution of the wind speed in the heat exchanger 5 can be improved.

While the indoor unit 102 illustrated in FIG. 6 includes two air-sending devices 4, the same applies to a case where three or more air-sending devices 4 are provided.

Figure 8:
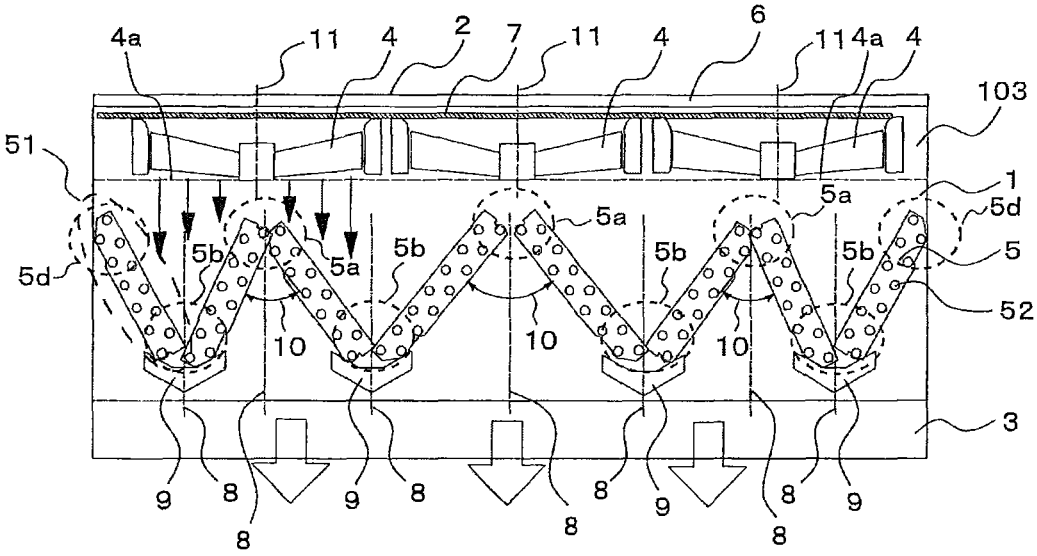
FIG. 8 is a vertical sectional view of another exemplary indoor unit for an air-conditioning apparatus (hereinafter denoted as indoor unit 103) according to Embodiment 3 of the present invention.

FIG. 8 is a vertical sectional view of another exemplary indoor unit for an air-conditioning apparatus (hereinafter denoted as indoor unit 103) according to Embodiment 3 of the present invention.

The indoor unit 103 illustrated in FIG. 8 includes three air-sending devices 4. Depending on the number of air-sending devices 4, it may be difficult to shift the mountain-side bent parts 5*a* of the heat exchanger 5 from positions on the downstream side of the outer peripheries of the impellers (or impeller portions) of the air-sending devices 4 to areas where the wind speed is low. In that case, the attaching angles 10 at the respective bent parts may be varied, as illustrated in FIG. 8, within a range smaller than or equal to the attaching-angle limit.

The configurations of the heat exchangers 5 of the indoor units 102, 102*b*, and 103 illustrated in FIGS. 6 and 8 are not limited to the above, similarly to Embodiments 1 and 2.

Embodiment 4

The heat exchanger 5 may be configured as described below. The following description of Embodiment 4 of the present invention focuses on differences from Embodiments 1 to 3 described above. Elements that are the same as those described in Embodiment 1, Embodiment 2, and Embodiment 3 are denoted by corresponding ones of the reference signs used therein.

Figure 9:
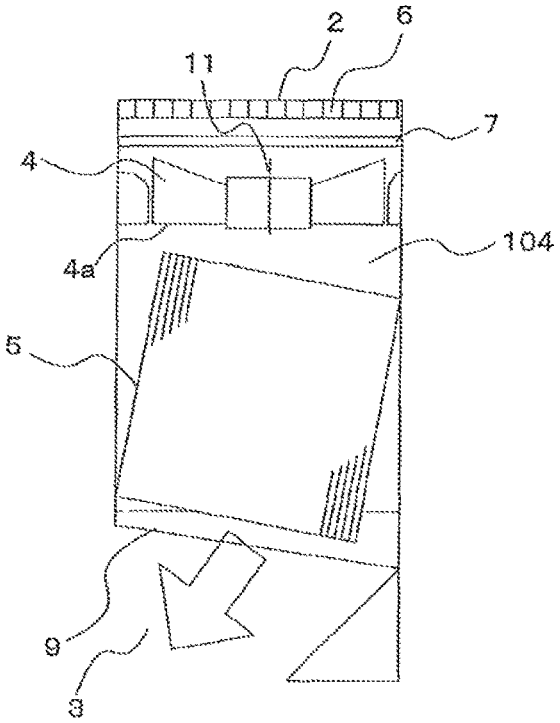
FIG. 9 is a vertical sectional view of an exemplary indoor unit for an air-conditioning apparatus (hereinafter denoted as indoor unit 104) according to Embodiment 4 of the present invention.

FIG. 9 is a vertical sectional view of an exemplary indoor unit for an air-conditioning apparatus (hereinafter denoted as indoor unit 104) according to Embodiment 4 of the present invention. The front side in FIG. 9 corresponds to the right side face of the indoor unit 104.

The indoor unit 104 for an air-conditioning apparatus according to Embodiment 4 of the present invention differs from the indoor units 100 to 103 for air-conditioning apparatuses according to Embodiments 1 to 3 in the arrangement of the heat exchanger 5.

The heat exchanger 5 of the indoor unit 104 is tilted toward the air outlet 3 in such a manner as to slope downward to the right with respect to the direction of airflow generated by the air-sending devices 4 (in the axial-flow direction), or with respect to the rear face of the casing 1 of the indoor unit 104. The pipes 52 (not illustrated) extending in the anteroposterior direction (the lateral direction in FIG. 9) of the heat exchanger 5 also slope downward to the right with respect to the rear face of the casing 1. The plate fins each extend perpendicularly to the pipes 52 and are stacked in the anteroposterior direction of the heat exchanger 5.

That is, the heat exchanger 5 is made to slope such that the outlet (not illustrated) of the passage of air provided between adjacent ones of the plate fins faces toward the air outlet 3 of the indoor unit 104.

According to the above configuration, the air flowing from the air-sending devices 4 in the axial-flow direction is rectified when passing through the sloping heat exchanger 5. Therefore, air around the air outlet 3 (around the bottom face) of the heat exchanger 5 flows out while the mainstream thereof is curved toward the front side (the left side in FIG. 9) of the heat exchanger 5 by an angle corresponding to the slope of the heat exchanger 5. Hence, the wind direction at the air outlet 3 of the indoor unit 104 can be controlled easily (particularly with respect to the horizontal direction), and the pressure loss that may be caused when the airflow is curved around the air outlet 3 can be reduced.

The configuration of the heat exchanger 5 of the indoor unit 104 illustrated in FIG. 9 is not limited to the above, similarly to Embodiments 1 to 3.

Embodiment 5

The heat exchanger 5 may be configured as described below. The following description of Embodiment 5 of the present invention focuses on differences from Embodiments 1 to 4 described above. Elements that are the same as those described in Embodiments 1 to 4 are denoted by corresponding ones of the reference signs used therein.

Figure 10:
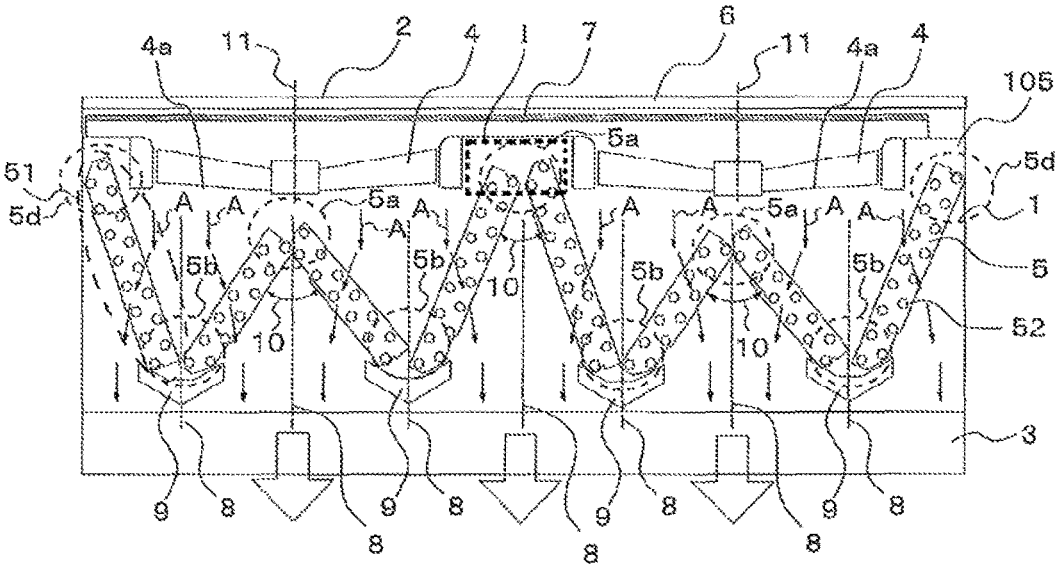
FIG. 10 is a vertical sectional view of an exemplary indoor unit for an air-conditioning apparatus (hereinafter denoted as indoor unit 105) according to Embodiment 5 of the present invention.

FIG. 10 is a vertical sectional view of an exemplary indoor unit for an air-conditioning apparatus (hereinafter denoted as indoor unit 105) according to Embodiment 5 of the present invention. The front side in FIG. 10 corresponds to the front face of the indoor unit 105.

The indoor unit 105 for an air-conditioning apparatus according to Embodiment 5 of the present invention differs from the indoor units 100 to 104 for air-conditioning apparatuses according to Embodiments 1 to 4 in the arrangement of the heat exchanger 5.

As illustrated in FIG. 10, some parts of the heat exchanger 5 are positioned on the upstream side (the upper side) of the air-sending-device air outlets 4*a*. FIG. 10 shows, for example, an entirety of a mountain-side bent part 5*a* that is provided in a non-limiting illustrative interval area 1 that is between adjacent air-sending devices 4. In the indoor unit 105 according to Embodiment 5 illustrated in FIG. 9, the above parts of the heat exchanger 5 are each positioned in a space between adjacent ones of the plurality of air-sending devices 4.

According to the above configuration, the mass of the heat exchanger 5 to be provided can be made larger than in the case where the heat exchanger 5 is positioned only on the downstream side of the air-sending-device air outlets 4*a*. Therefore, the area of heat exchange can be made larger than in the above case. Thus, the pressure loss at the heat exchanger 5 can be reduced.

The configuration of the heat exchanger 5 of the indoor unit 105 illustrated in FIG. 10 is not limited to the above, similarly to Embodiments 1 to 4.

Embodiment 6

Figure 11:
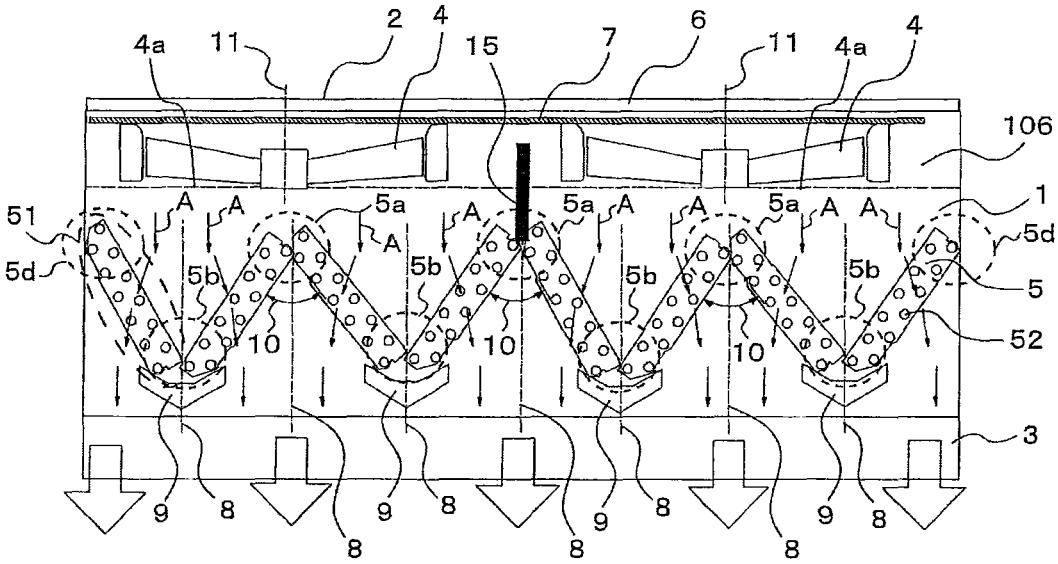
FIG. 11 is a vertical sectional view of an exemplary indoor unit for an air-conditioning apparatus (hereinafter denoted as indoor unit 106) according to Embodiment 6 of the present invention.

FIG. 11 is a vertical sectional view of an exemplary indoor unit for an air-conditioning apparatus (hereinafter denoted as indoor unit 106) according to Embodiment 6 of the present invention. The front side in FIG. 11 corresponds to the front face of the indoor unit 106.

The basic configuration of the indoor unit 106 is the same as that of the indoor unit 101 for an air-conditioning apparatus illustrated in FIG. 5, except that a partition 15 that separates adjacent ones of the air-sending devices 4 from each other in front view of the casing 1 is provided on the upstream side (the upper side) of the heat exchanger 5.

The partition 15 is provided on the upstream side (the upper side) of the heat exchanger 5 and between adjacent ones of the air-sending devices 4. The partition 15 extends in the anteroposterior direction of the casing 1 (the direction orthogonal to the plane of FIG. 11) along the heat exchanger 5 in such a manner as to separate the flows of air generated by the respective air-sending devices 4. Thus, the partition 15 separates the inside of the casing 1.

Therefore, the flows of air generated by adjacent ones of the air-sending devices 4 can be prevented from colliding with each other, contributing to an improvement in the air-sending efficiency of the air-sending devices 4, a noise reduction, and the like.

Furthermore, positioning one of the mountain-side bent parts 5*a* of the heat exchanger 5 between each pair of adjacent air-sending devices 4 while positioning the partition 15 above that mountain-side bent part 5*a* allows a reduction in the length of the partition 15 in the vertical direction. Furthermore, the mountain-side bent parts 5*a* of the heat exchanger 5 each have a function of separating a part of the space between adjacent ones of the air-sending devices 4, and an advantageous effect equivalent to an effect produced by increasing the length of the partition 15 downward is also obtained. Consequently, the air-sending efficiency is further improved. In this case, the partition 15 extends in the anteroposterior direction of the casing 1 (in the direction orthogonal to the plane of FIG. 11) along the mountain-side bent part 5*a* of the heat exchanger 5.

The upper end of the partition 15 is desirably at the same height as the air-sending-device air outlets 4*a* or the lower ends of bell mouths (not illustrated) provided around the respective air-sending devices 4, or more desirably at a position higher than the above. Specifically, the upper end of the partition 15 is desirably at a position close to the top of the inner side of the casing 1. The effect of preventing the collision between the flows of air from adjacent ones of the air-sending devices 4 is obtained without the partition 15, as long as the mountain-side bent parts 5*a* of the heat exchanger 5 are at the same height as or at a position higher than the lower ends of the air-sending devices 4 or the lower ends of their bell mouths (the air-sending-device air outlets 4*a*) similarly to the indoor unit 105 for an air-conditioning apparatus according to Embodiment 5 illustrated in FIG. 10. Even in that case, however, it is recommended to provide the partition 15 above a corresponding one of the mountain-side bent parts 5*a*.

When the partition 15 that separates the inside of the casing 1 is directly fixed to the mountain-side bent part 5*a* of the heat exchanger 5, the configuration is simple. Alternatively, if the partition 15 is directly fixed to the inner side of the casing 1 with a small gap provided with respect to the mountain-side bent part 5*a* of the heat exchanger 5 not to be in contact with the heat exchanger 5, the partition 15 can be prevented from being affected by changes in the temperature of the heat exchanger 5. Exemplary materials for the partition 15 include resin and metal. It is more desirable that the partition 15 be made of a soft material such as a rubber sheet or a porous material such as styrene foam, because a high sound-absorbing effect in the casing 1 is produced.

According to the above configuration, the partition 15 separates the flows of air generated by adjacent ones of the air-sending devices 4 from each other. Thus, the collision between such flows of air can be prevented, contributing to an improvement in the air-sending efficiency of the air-sending devices 4, a noise reduction, and the like.

The configuration of the heat exchanger 5 of the indoor unit 106 illustrated in FIG. 11 is not limited to the above, similarly to Embodiments 1 to 5.

REFERENCE SIGNS LIST

1 casing 2 air inlet 3 air outlet 4 air-sending device 4*a* air-sending-device air outlet 5 heat exchanger 5*a* mountain-side bent part 5*b* valley-side bent part 5*c* downslope end 5*d* upslope end 6 finger guard 7 filter 8 boundary 9 drain pan 10 attaching angle 11 rotating shaft 15 partition 51 elemental heat exchanger 52 pipe 100 indoor unit 100*b* indoor unit 101 indoor unit 102 indoor unit 102*b* indoor unit 103 indoor unit 104 indoor unit 105 indoor unit 106 indoor unit

The invention claimed is:

1. An indoor unit for an air-conditioning apparatus, the indoor unit comprising:

a casing having an air inlet at a top and an air outlet at a bottom;

a plurality of air-sending devices provided in the casing and on a downstream side of the air inlet and each including an axial-flow fan or a mixed-flow fan; and a heat exchanger provided in the casing and between the plurality of air-sending devices and the air outlet, wherein the heat exchanger includes a plurality of bent parts where a direction of slope of the heat exchanger changes from an upward direction to a downward direction or from a downward direction to an upward direction, the plurality of bent parts being provided on each of a side of the air inlet and a side of the air outlet, wherein the heat exchanger is provided such that all of the plurality of bent parts are spaced apart from one another in a left and right direction and are visible when the heat exchanger is seen in a vertical sectional view of the indoor unit from a front side of the casing, wherein the plurality of air-sending devices are placed apart from one another so that an interval area is formed between adjacent air-sending devices of the plurality of air-sending devices in the left and right direction along which the plurality of bent parts are spaced apart from one another, wherein drain pans are provided below each of the plurality of bent parts that are on the side of the air outlet, wherein at least one of the plurality of bent parts being provided on the side of the air inlet is a first bent part, an entirety of the first bent part being provided in the interval area that is between the adjacent air-sending devices and aligned with the interval area in the left and right direction, wherein at least one of the plurality of bent parts being provided on the side of the air inlet, excluding the first bent part, is a second bent part, an entirety of the second bent part being provided below one of the plurality of air-sending devices, and wherein the first bent part is positioned higher than the second bent part.

2. The indoor unit for an air-conditioning apparatus of claim 1, wherein, when the heat exchanger is seen in the vertical sectional view of the indoor unit from the front side of the casing, right and left ends of the heat exchanger are each an upslope end.

3. The indoor unit for an air-conditioning apparatus of claim 1, wherein, when the heat exchanger is seen in the vertical sectional view of the indoor unit from the front side of the casing, right and left ends of the heat exchanger are each a downslope end, and wherein drain pans are provided below the respective downslope ends.

4. The indoor unit for an air-conditioning apparatus of claim 1, wherein the second bent part is positioned below a rotating shaft of one of the plurality of air-sending devices.

5. The indoor unit for an air-conditioning apparatus of claim 1, wherein the second bent part is positioned in an area other than an area that faces an air outlet of one of the plurality of air-sending devices.

6. The indoor unit for an air-conditioning apparatus of claim 1, wherein the air outlet is provided on the front side at the bottom of the casing, and wherein the heat exchanger is tilted toward the air outlet such that the heat exchanger slopes downward to a right with respect to a rear face of the casing.

7. The indoor unit for an air-conditioning apparatus of claim 1, wherein a partition that separates an area of adjacent two of the plurality of air-sending devices from each other is provided above the heat exchanger.

8. The indoor unit for an air-conditioning apparatus of claim 7, wherein the partition is provided above the plurality of bent parts of the heat exchanger that are on the side of the air inlet.

9. An air-conditioning apparatus comprising:

the indoor unit for an air-conditioning apparatus of claim 1.

10. The indoor unit for an air-conditioning apparatus of claim 1, wherein the indoor unit is a wall-mounted indoor unit.

* * * * *